US011312601B1

(12) United States Patent
Yao

(10) Patent No.: US 11,312,601 B1
(45) Date of Patent: Apr. 26, 2022

(54) MOVABLE LIFTING BRACKET

(71) Applicant: SHENZHEN GLOBAL PURCHASE TRADING CO., LTD, Shenzhen (CN)

(72) Inventor: Jianmei Yao, Shenzhen (CN)

(73) Assignee: SHENZHEN GLOBAL PURCHASE TRADING CO., LTD, Shenzhen (CN)

( * ) Notice: Subject to any disclaimer, the term of this patent is extended or adjusted under 35 U.S.C. 154(b) by 0 days.

(21) Appl. No.: 17/533,085

(22) Filed: Nov. 22, 2021

(51) Int. Cl.
*B66F 7/00* (2006.01)
*B66F 7/06* (2006.01)

(52) U.S. Cl.
CPC ..... *B66F 7/0641* (2013.01); *B66F 7/0625* (2013.01)

(58) Field of Classification Search
CPC ... B23Q 1/03; B23Q 1/25; B23Q 1/26; B23Q 3/00; B23Q 3/06; B25B 11/00; B66F 5/00; B66F 7/00; B66F 9/00; B66F 9/127
See application file for complete search history.

(56) References Cited

U.S. PATENT DOCUMENTS 4,183,511 A * 1/1980 Marek ..... B66C 23/48 254/100
5,662,315 A * 9/1997 Neiss ..... B25H 1/0007 254/134
6,173,947 B1 * 1/2001 Johnson ..... B05B 13/0285 269/17
7,448,606 B1 * 11/2008 Johnson ..... B05B 13/0285 269/16
2009/0184217 A1 * 7/2009 Sprout ..... B25H 1/0007 248/124.1

* cited by examiner

*Primary Examiner* — Lee D Wilson

(57) ABSTRACT

A movable lifting bracket relates to a field of lifting bracket and includes bearing frames, a main frame, and a mobile frame arranged on a lower portion of the main frame. Universal wheels and directional wheels are arranged on a lower portion of the movable frame. Adjusting sleeves are arranged on upper ends of the movable frame. First through holes are on an outer side of each of the adjusting sleeves. Lower ends of the main frame are inserted into the adjusting sleeves. A first limit pin is arranged on the outer side of each of the adjusting sleeves; A pressing frame is arranged on the main frame.

9 Claims, 9 Drawing Sheets

MOVABLE LIFTING BRACKET

TECHNICAL FIELD

The present disclosure relates to a field of lifting bracket technology, and in particular to a movable lifting bracket.

BACKGROUND

Car interiors, as the name suggests, are decorative components inside a car. The car interiors that we usually define are components that have only decorative effects. However, from a perspective of an automotive professional field, these components are not only decorative, but the functionality, security, and engineering attributes that they involve are very rich.

When facing different needs of consumers, automobile manufacturers add different functional attributes to the car, including a roof that is removably arranged on a jeep. However, when this kind of roof on the jeep is removed, it is mostly done manually. Further, it also needs to be equipped with heavy supporting equipment. Moreover, after the roof is removed, manpower is required to move it away, which greatly increases difficulty of removing the roof.

SUMMARY

The present disclosure provides a movable lifting bracket. The movable lifting bracket is able to quickly move under a vehicle roof, and the vehicle roof is propped up by manpower only, and then transported to another place, thereby greatly reducing difficulty of disassembling and transporting the vehicle.

The movable lifting bracket comprises bearing frames, a main frame, and a mobile frame arranged on a lower portion of the main frame. Universal wheels and directional wheels are arranged on a lower portion of the movable frame.

Adjusting sleeves are sleeved on upper ends of the movable frame. The adjusting sleeves are sleeved on lower ends of the main frame. First through holes are on an outer side of each of the adjusting sleeves. Second through holes are on outer sides of the main frame. Third through holes are on outer sides of the movable frame. The movable limiting frame further comprises first limit pins and second limit pins. The first limits pins insert into the first through holes and the second through holes to fix the adjusting sleeves with the main frame. The second limit pins insert into the first through holes and the third through holes to fix the adjusting sleeves with the movable frame. The adjusting sleeves are sleeved on and fixed with the main frame and the movable frame to adjust a height of the movable lifting bracket.

A pressing frame is arranged on the main frame. A first handbrake controller and a second handbrake controller are mounted on the pressing frame. The pressing frame is connected with the main frame through first fixing pieces.

A lower end of each of the bearing frames is connected with a respective end of the pressing frame. The bearing frames are connected with the main frame through auxiliary moving rods. A limit teeth plate is arranged on an upper portion of the main frame through second fixing pieces. The limit teeth plate is arc-shaped. Camping teeth are arranged on an outer side of the limit teeth plate. A limit plate matched with the limit teeth plate is arranged on one end of the pressing frame. A tension spring is connected to a lower side of the limit plate. A horizontal plate engaged with the clamping teeth is arranged on an inner side of the limit plate.

Cushions are arranged on an upper portion of each of the bearing frames. A first adjusting bolt is connected with a lower end of each of the cushions. Each of the cushions are connected with each of the bearing frames through a corresponding first adjusting bolt. A fixed frame is connected with a lower side of each of the bearing frames. Auxiliary support rods are connected with one side of the fixed frame. A support block is arranged on one end of each of the auxiliary support rods. A second adjusting bolt is connected with a lower end of each of the support block. Each support block is connected with each of the auxiliary support rods through each second adjusting bolt.

Optionally, a non-slip sleeve is mounted on an outer side of the pressing frame.

Optionally, each of the bearing frames is connected with the pressing frame through a third fixing piece. The bearing frames and the main frame are connected with the auxiliary moving rods through the fourth fixing pieces.

Optionally, the horizontal plate arranged on an inner side of the limit the limit plate is engaged with the clamping teeth of the limit teeth plate. A fifth fixing pieces is arranged on a middle portion of the limit plate.

Optionally, a control wire of the first handbrake controller is connected with an upper end of the limit plate.

Optionally, stabilizing support mechanisms are connected with the bearing frame. A lower portion of each of the bearing frame is received in an interior of a respective stabilizing support mechanism. An outer sleeve is arranged on one side of each of the stabilizing support mechanisms. A connecting rod is arranged on one side of each outer sleeve. An abutting block is arranged at one end of each connecting rod.

Optionally, the upper end of each abutting block is arc-shaped, and the upper end of each abutting block is made of rubber material.

Optionally, a spring is arranged in the interior of each of the stabilizing support mechanisms.

Optionally, a pressing plate is arranged on an outer side of the lower portion of each of the bearing frames. One end of each pressing plate inserts into an interior of a corresponding outer sleeve.

Optionally, each outer sleeve is sleeved on an outer side of each connecting rod. Fourth through holes are on each outer sleeve and each connecting rod. A stop pin is arranged on each outer sleeve. Each outer sleeve is connected with a corresponding connecting rod though cooperation of the fourth through holes and a corresponding stop pin.

Optionally, a lower end of each pressing plate is inclined, and one end of the outer sleeve inserted into the stabilizing support mechanism is inclined.

Optionally, a clamping mechanism is arranged on an outer side of an upper end of each of the stabilizing support mechanisms. A clamping block is arranged on an outer side of the lower portion of each of the bearing frames. The second handbrake controller is connected with one end of a corresponding clamping mechanism.

Compared with the prior art, with the universal wheels and the directional wheels arranged on the lower portion of the movable frame, the movable frame is manually pushed to move by manpower, so the movable frame is quickly moves under a vehicle roof that needs to be removed.

The pressing frame is arranged on the main frame. The pressing frame is connected with the main frame through the first fixing pieces. The lower end of each of the bearing frames is connected with the respective end of the pressing frame. When the vehicle roof needs to be lifted upwards, a user only needs to press down one side of the pressing frame to apply a downward force, then the pressing frame rotates with the first fixing pieces connected to the main frame as a center of the circle, so that another ends connected with the bearing frames moves upward under action of the lever principle. Therefore, the bearings frames drive the vehicle roof to move upward to achieve effect that the vehicle roof is lifted up by manpower without using heavy equipment. The bearing frames are connected with the main frame through the auxiliary moving rods, which improves stability of the bearing frames when moving up. The limit teeth plate is arranged on the upper portion of the main frame through the second fixing piece. The limit teeth plate is arc-shaped. The clamping teeth are arranged on the outer side of the limit teeth plate. The limit plate matched with the limit teeth plate is arranged on one end of the pressing frame. The tension spring is connected to the lower side of the limit plate.

Therefore, when the pressing frame is rotated by applying force, the limit plate intermittently overcome force of the tension spring under action of the clamping teeth to rotate with a center of the fifth fixing piece as a center. When stop applying the force, the limit plate is engaged with the limit teeth plate, and a rotation angle of the pressing frame and a move-up height of the bearing frames are fixed, thereby achieving effect of lifting or fixing the vehicle roof at any time, which greatly improves disassembly efficiency of the vehicle roof.

The cushions are arranged on the upper portion of each of the bearing frames. The first adjusting bolt is connected with the lower end of each of the cushions. Each of the cushions are connected with each of the bearing frames through the corresponding first adjusting bolt. By controlling an upward extension length of each first adjusting bolt, each of the cushions contacts with an uneven inner surface of the vehicle roof to avoid deformation of the vehicle roof caused by uneven force.

The fixed frame is connected with the lower side of each of the bearing frames. The auxiliary support rods are connected with one side of the fixed frame. The support block is arranged on the one end of each of the auxiliary support rods. The second adjusting bolt is connected with the lower end of each of the support block. Each support block is connected with each of the auxiliary support rods through each second adjusting bolt. Therefore, a contact area between the bearing frames and an inner side of the vehicle roof is increased, which improves stability of subsequent transportation. Moreover, each support block contacts with the uneven inner surface of the vehicle roof to ensure that the force on the inner side of the vehicle roof is even.

The adjusting sleeves are sleeved on the upper ends of the movable frame and lower ends of the main frame. The first through holes are on the outer side of each of the adjusting sleeves. The second through holes are on the outer sides of the main frame. The third through holes are on the outer sides of the movable frame. The first limits pins insert into the first through holes and the second through holes to fix the adjusting sleeves with the main frame. The second limit pins insert into the first through holes and the third through holes to fix the adjusting sleeves with the movable frame. The adjusting sleeves are sleeved on and fixed with the main frame and the movable frame to adjust a height of the movable lifting bracket. Therefore, the movable lifting bracket adapts to disassembly of the vehicle roof of different models of vehicles.

By providing the non-slip sleeve mounted on the outer side of the pressing frame, use of the movable lifting bracket is further facilitated.

The stabilizing support mechanisms are connected with the bearing frames. The lower portion of each of the bearing frame is received in the interior of the respective stabilizing support mechanism. The outer sleeve is arranged on one side of each of the stabilizing support mechanisms. The connecting rod is arranged on one side of each outer sleeve. The abutting block is arranged at one end of each connecting rod. When the bearing frames support the vehicle roof, each spring in the corresponding stabilizing support mechanism is compressed, so each pressing plate enters the corresponding stabilizing support mechanism and contacts with one side of the corresponding outer sleeve. Thus, each outer sleeve drives the corresponding connecting rod and the corresponding abutting block to move outward to contact an edge of the vehicle roof to support the edge of the vehicle roof, so that when the vehicle roof is transported on a road that is inclined or uneven, they also prevent the vehicle roof from sliding over on the upper portions of the bearing frames, thereby improving the stability of the vehicle roof during transportation.

The upper end of each abutting block is arc-shaped, and the upper end of each abutting block is made of rubber material, which increase a contact area between each abutting block and the edge of the vehicle roof, thereby improving the stability of the vehicle roof during transportation. Each outer sleeve is sleeved on the outer side of each connecting rod. The fourth through holes are on each outer sleeve and each connecting rod. A stop pin is arranged on each outer sleeve. Each outer sleeve is connected with the corresponding connecting rod though cooperation of the fourth through holes and the corresponding stop pin, so a length of each connecting rod into the corresponding outer sleeve is adjusted and the movable lifting bracket adapts to different types of vehicle roofs.

The first handbrake controller and the second handbrake controller are mounted on the pressing frame. The control wire of the first handbrake controller is connected with the upper end of the limit plate. When the bearing frames need to be reset, the first handbrake controller is pulled to drive the limit plate to rotate to release engagement with the limit teeth plate, so that the bearing frames are quickly reset.

The clamping mechanism is arranged on the outer side of the upper end of each of the stabilizing support mechanisms. The clamping block is arranged on the outer side of the lower portion of each of the bearing frames. The second handbrake controller is connected with one end of the corresponding clamping mechanism.

When each of the bearing frames compresses the corresponding spring in the corresponding stabilizing support mechanism, each clamping block is engaged with the corresponding clamping mechanism, thereby further improving the stability of the vehicle roof during subsequent transportation. The second handbrake controller is pulled to quickly released engagement of each clamping block with the corresponding clamping mechanism.

BRIEF DESCRIPTION OF DRAWINGS

The drawings are included to provide a further understanding of embodiments of the present disclosure, which form portions of the specification and are used to illustrate implementation manners of the present disclosure and are intended to illustrate operating principles of the present disclosure together with the description. Apparently, the drawings in the following description are merely some of the embodiments of the present disclosure, and those skilled in the art are able to obtain other drawings according to the drawings without contributing any inventive labor. In the drawing.

In the drawings.

1—Bearing frame; 101—Cushion; 102—Fixed frame; 2—Auxiliary moving rod; 3—pressing frame; 301—First handbrake controller; 302—Second handbrake controller; 303—fifth fixing piece; 4—Main frame; 401—limit teeth plate; 402—limit plate; 403—tension spring; 404—first fixing piece, 405—second fixing piece; 406—second through holes; 5—adjusting sleeve; 501—first through hole; 6—movable frame; 601—universal wheel; 602—directional wheel; 603—third through holes; 7—first limit pin; 71—second limit pin; 8—auxiliary support rod; 801—support block; 9—stabilizing support mechanism; 901—spring; 10—abutting block; 11—clamping block; 12—pressing plate; 13—connecting rod; 14—outer sleeve; 141—fourth through hole; 142—stop pin; 15—Clamping mechanism.

DETAILED DESCRIPTION

Figure 1:
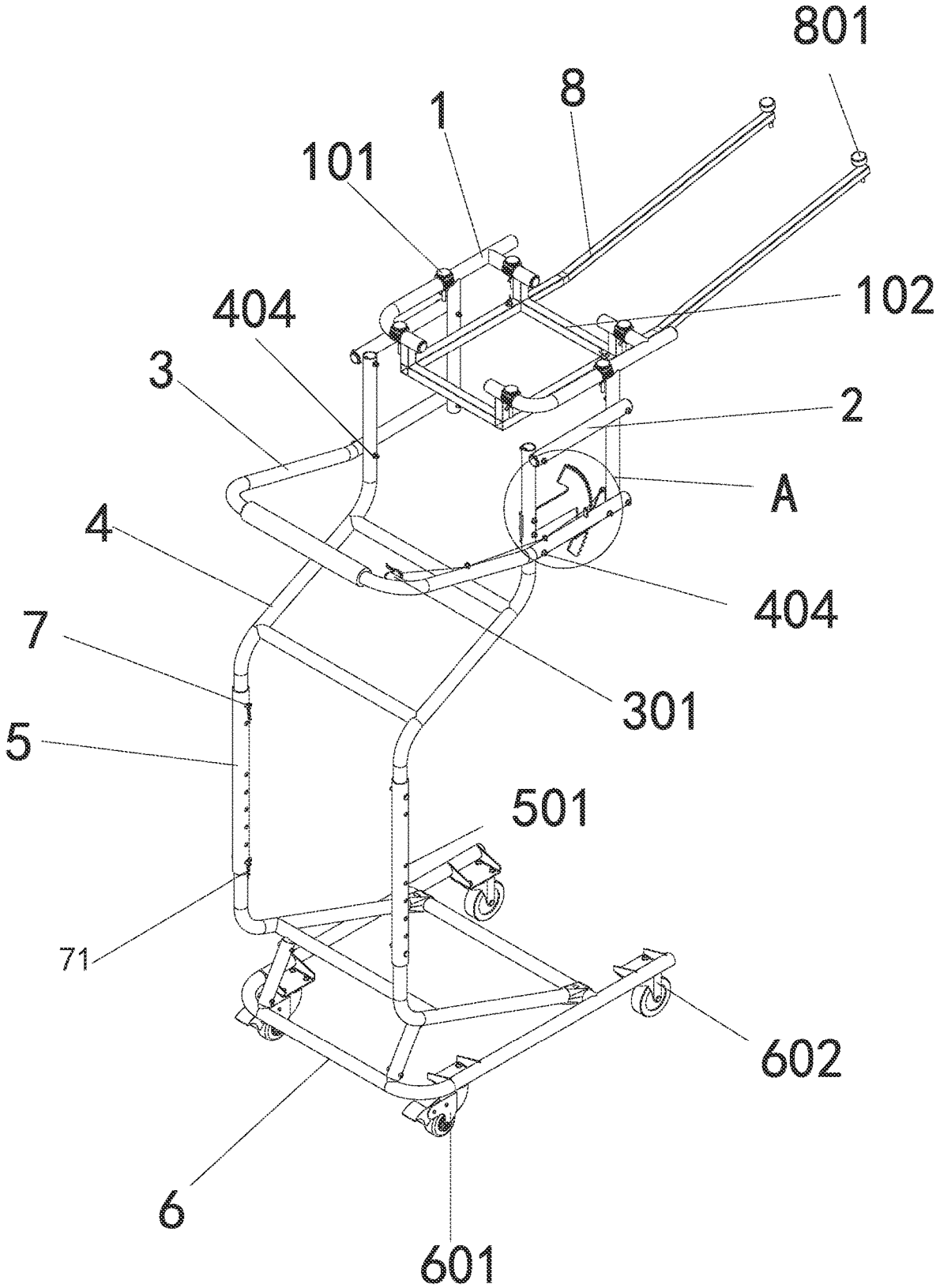
FIG. 1 is a schematic diagram showing an overall structure of a movable lifting bracket according to a first embodiment of the present disclosure.
Figure 2:
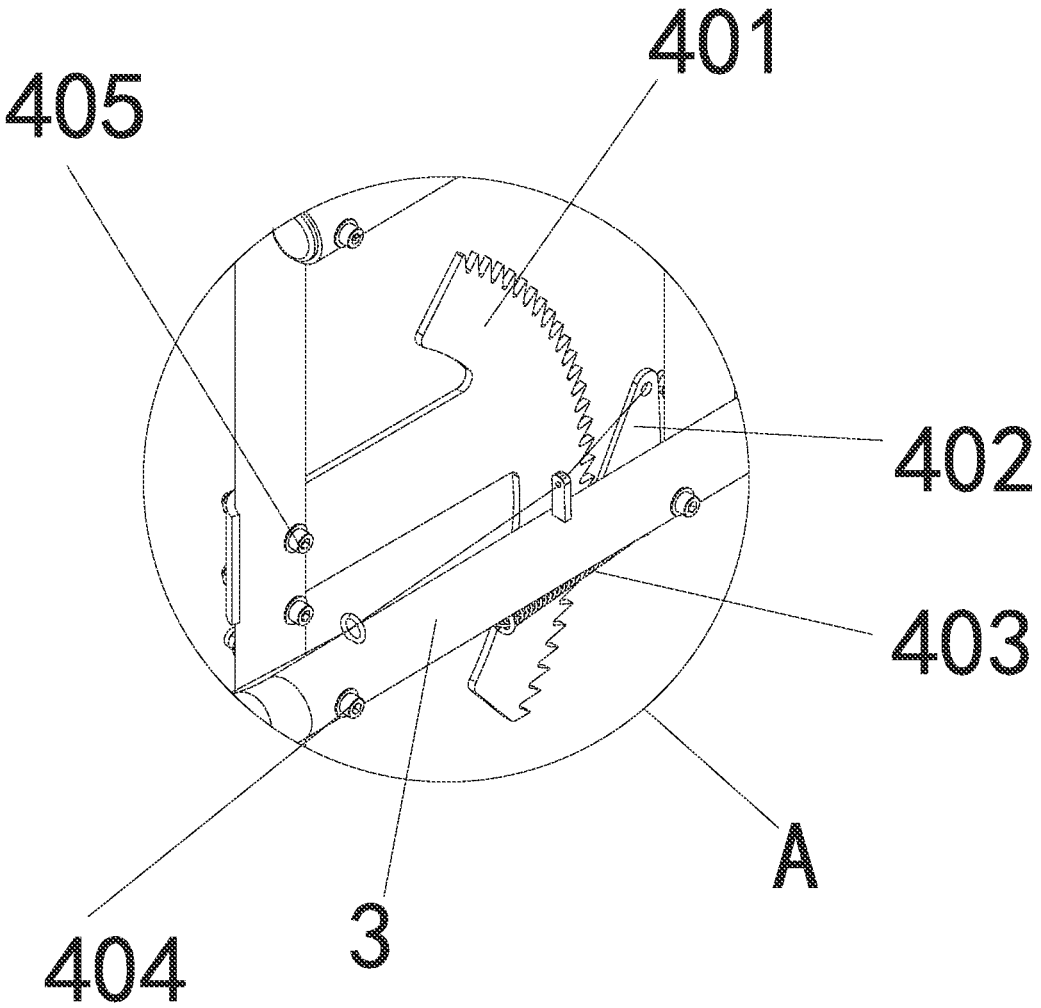
FIG. 2 is an enlarged view of portion A shown in FIG. 1.
Figure 3:
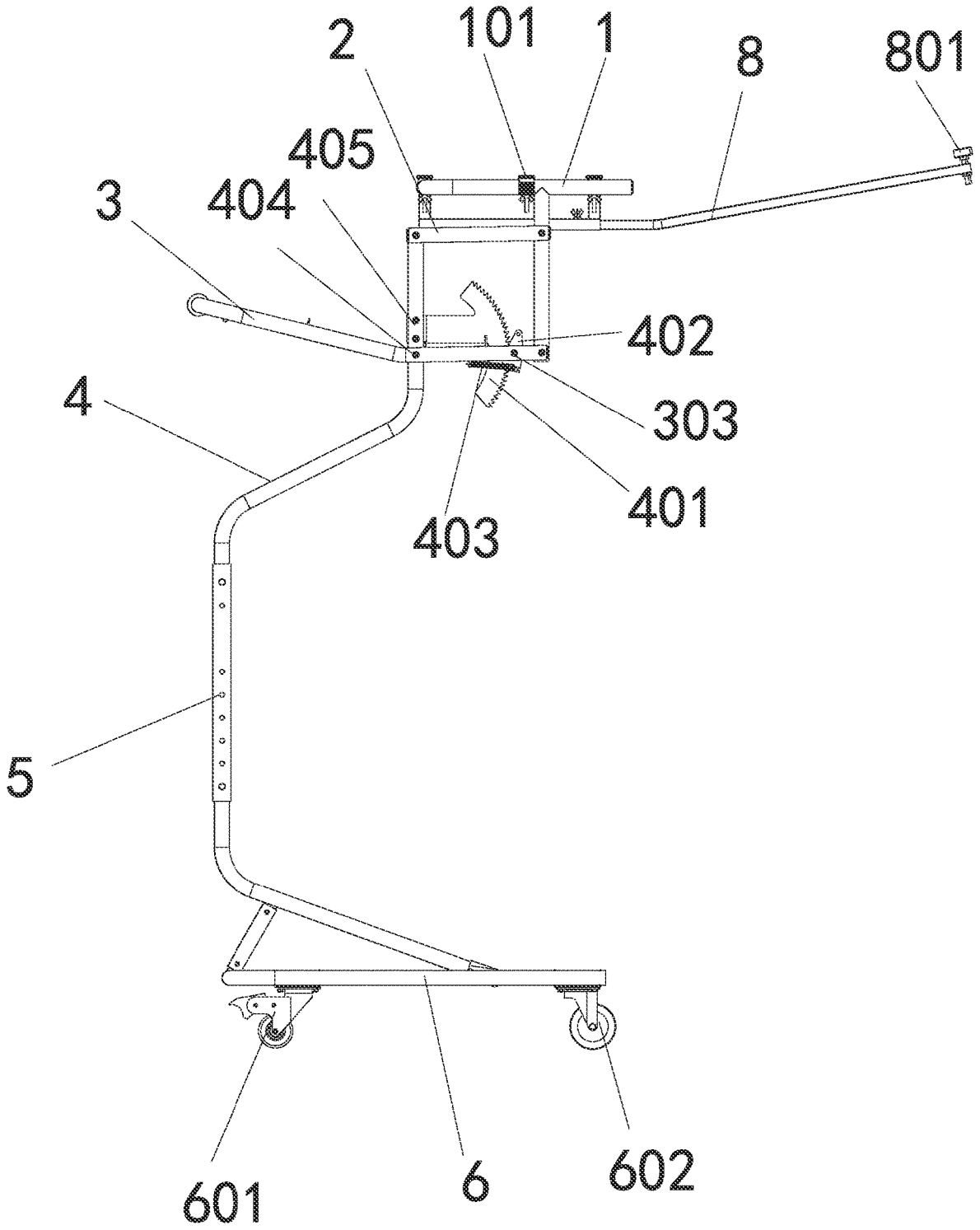
FIG. 3 is a left side schematic diagram of the movable lifting bracket according to the first embodiment of the present disclosure.
Figure 4:
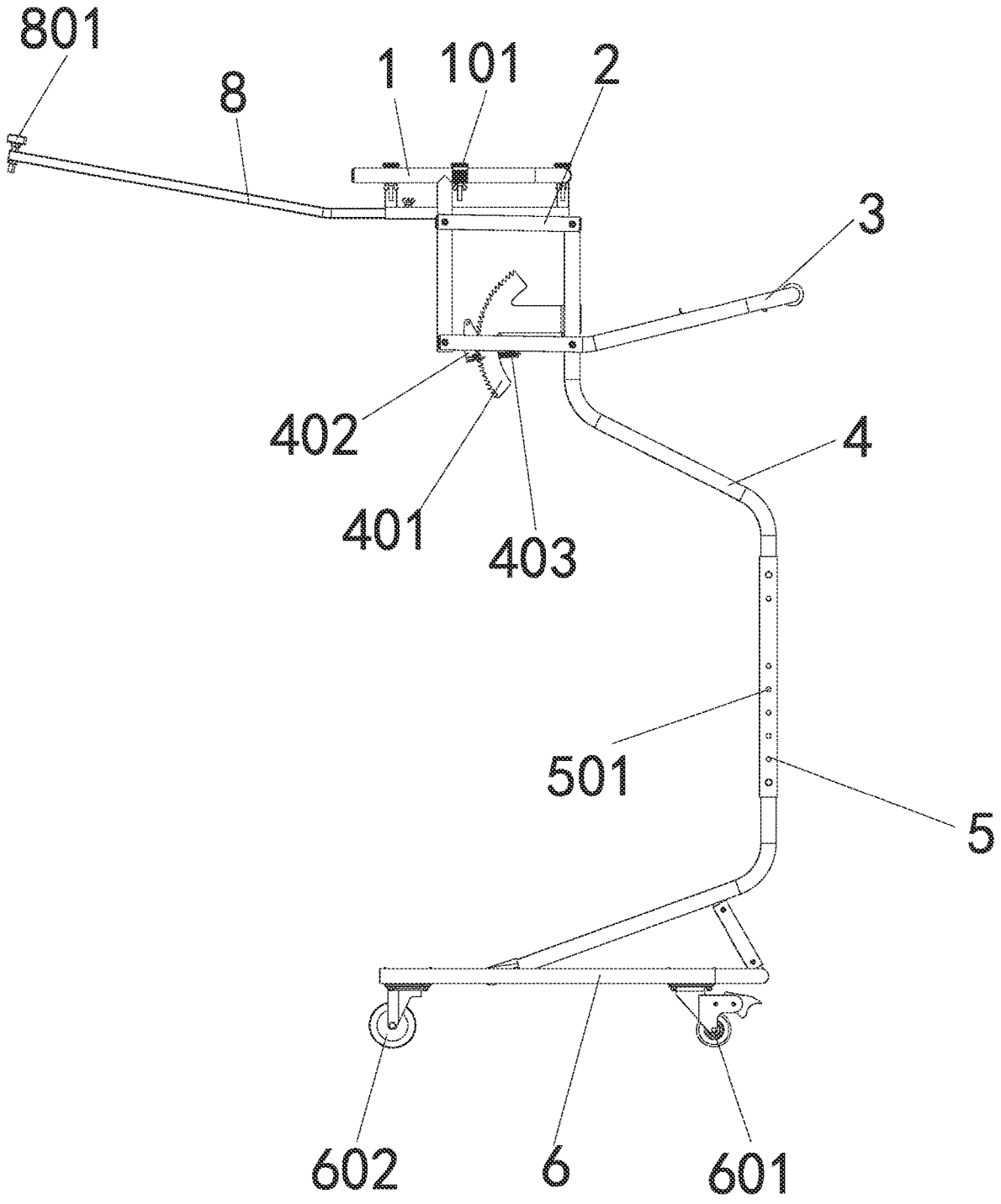
FIG. 4 is a right side schematic diagram of the movable lifting bracket according to the first embodiment of the present disclosure.
Figure 5:
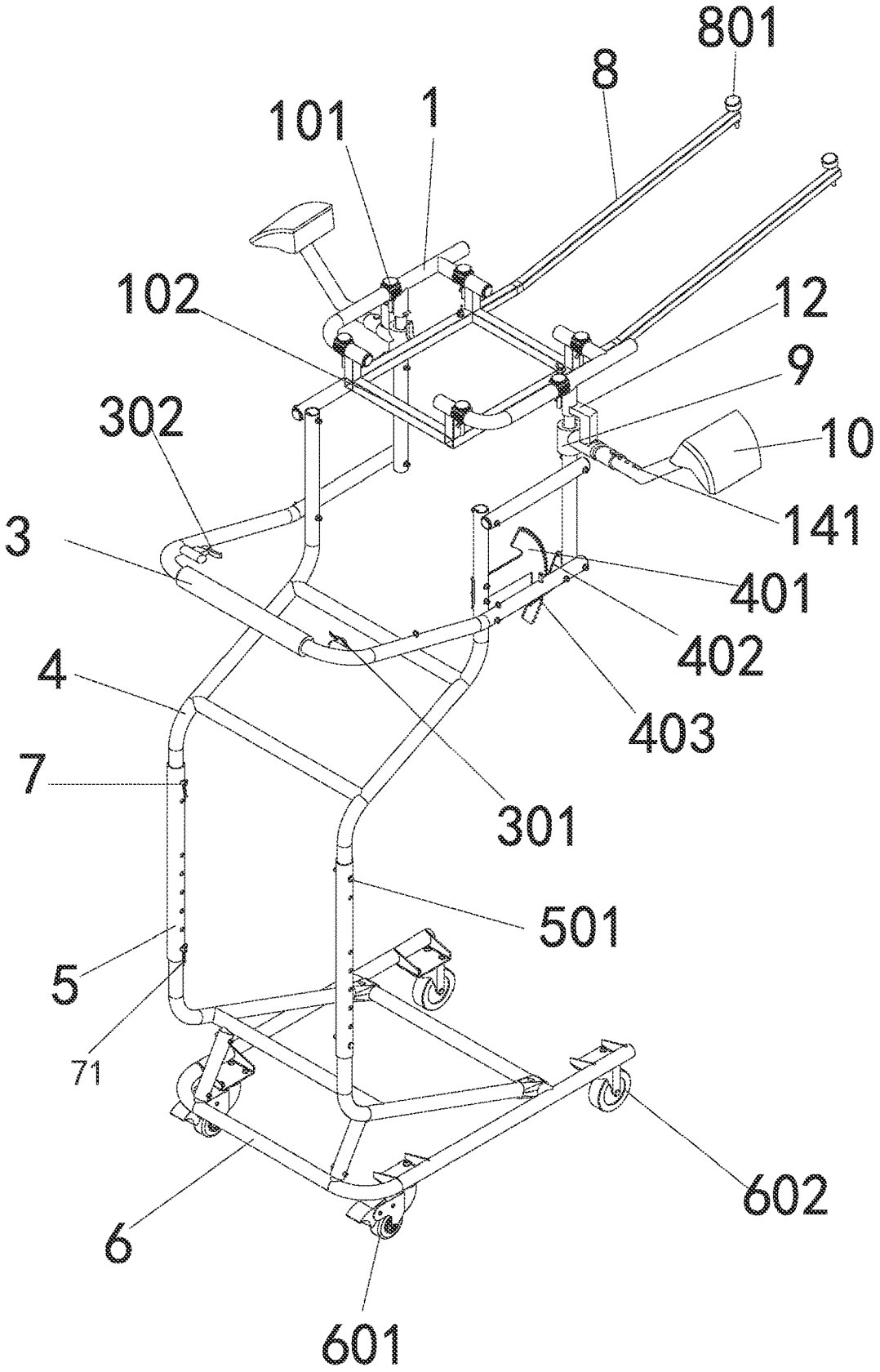
FIG. 5 is a perspective schematic diagram of the movable lifting bracket according to a second embodiment of the present disclosure.
Figure 6:
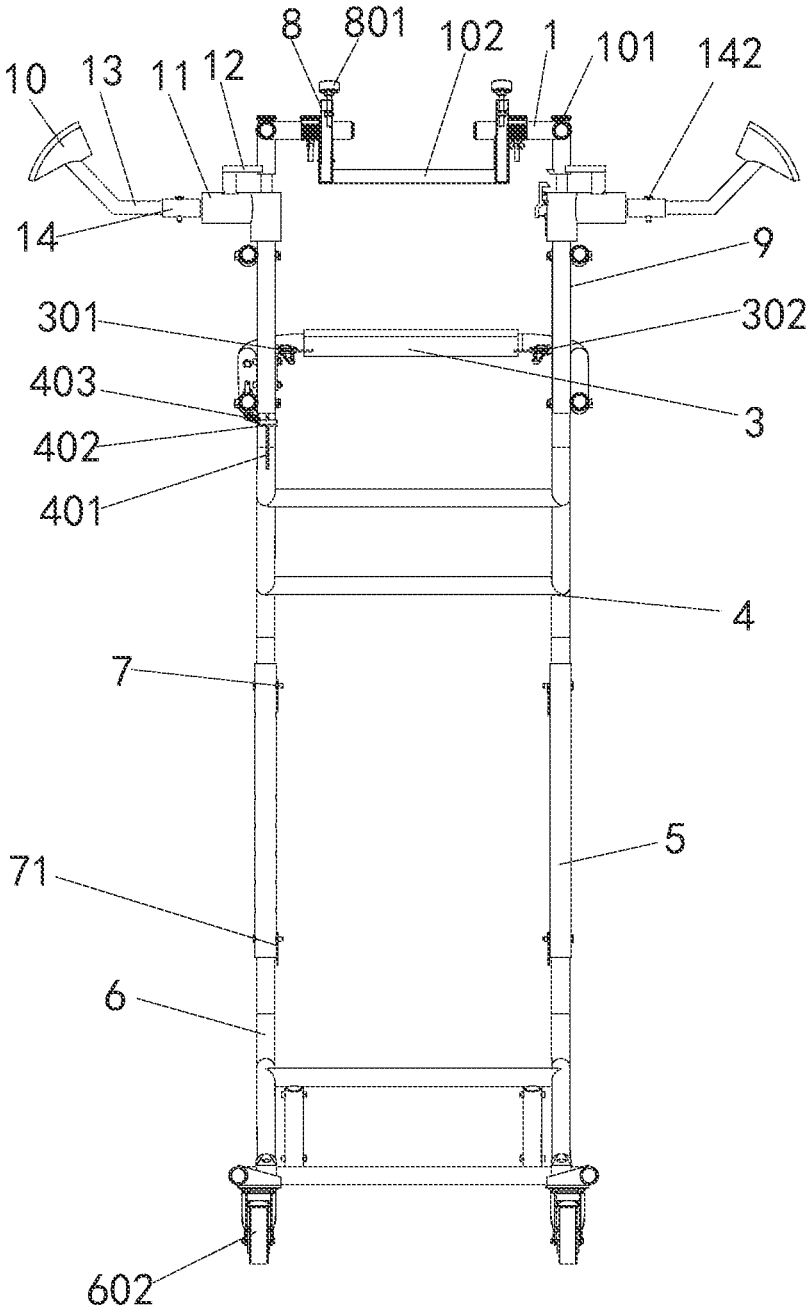
FIG. 6 is a rear schematic diagram of the movable lifting bracket according to the second embodiment of the present disclosure.
Figure 7:
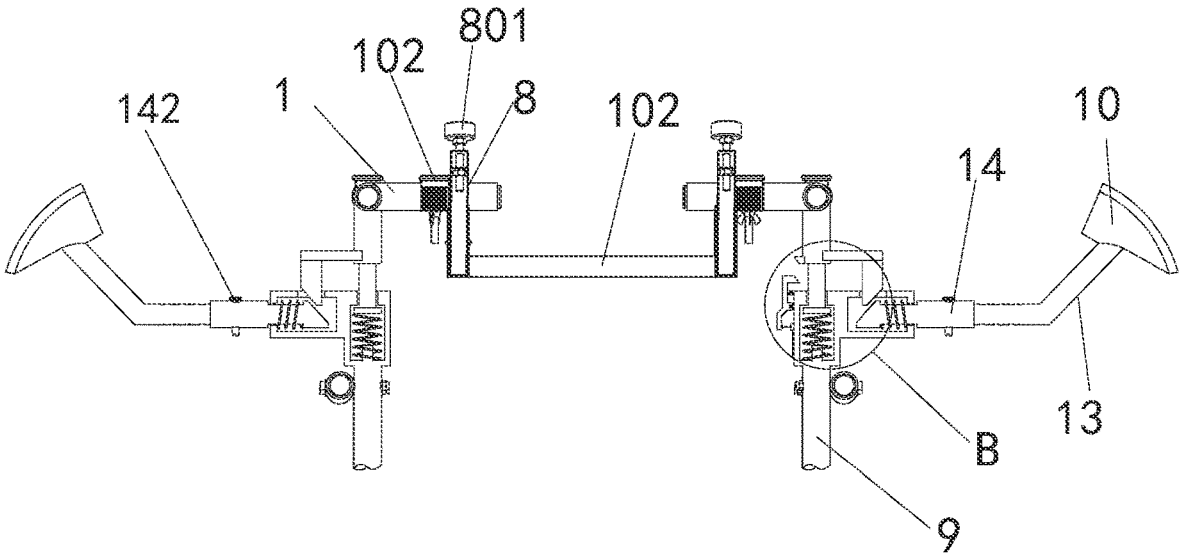
FIG. 7 is a perspective schematic diagram showing an interior of stabilizing support mechanisms according to the second embodiment of the present disclosure.
Figure 8:
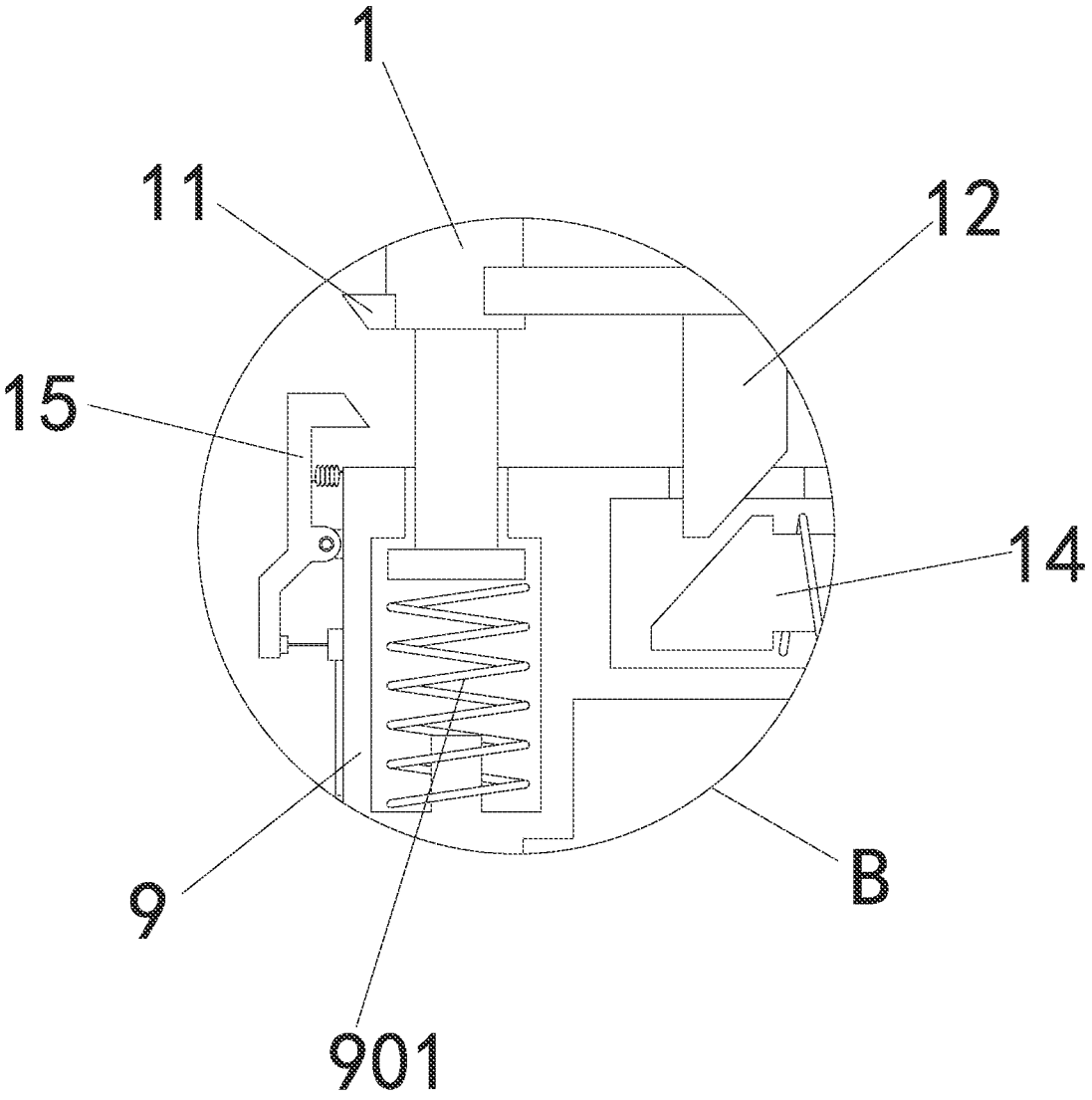
FIG. 8 is an enlarged view of portion B shown in FIG. 7.
Figure 9:
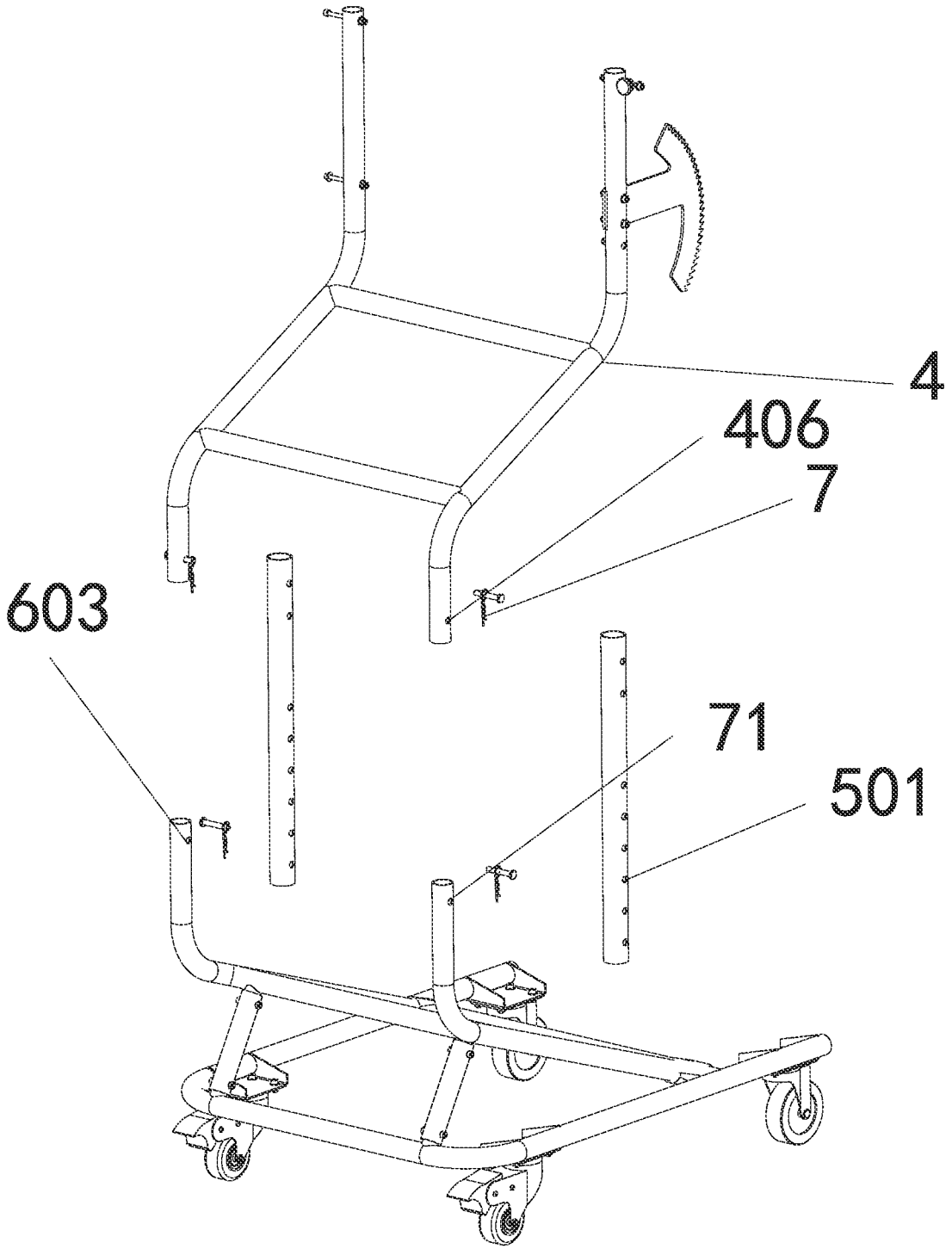
FIG. 9 is an exploded perspective view of a main frame, a movable frame, and adjusting sleeves.

FIGS. 1-9 are elevational schematic diagrams and perspective schematic diagrams of a movable lifting bracket of the present disclosure.

Embodiment 1

The movable lifting bracket comprises bearing frames 1, a main frame 4, and a mobile frame 6 arranged on a lower portion of the main frame 4. Universal wheels 601 and directional wheels 602 are arranged on a lower portion of the movable frame 6. Adjusting sleeves 5 are sleeved on upper ends of the movable frame 6. The adjusting sleeves 5 are sleeved on lower ends of the main frame 4. First through holes 501 are on an outer side of each of the adjusting sleeves. Second through holes 406 are on outer sides of the main frame. Third through holes 603 are on outer sides of the movable frame 6. The movable limiting frame further comprises first limit pins 7 and second limit pins 71. The first limits pins 7 insert into the first through holes 501 and the second through holes 406 to fix the adjusting sleeves 5 with the main frame 4. The second limit pins 71 insert into the first through holes 501 and the third through holes 603 to fix the adjusting sleeves with the movable frame 6. The adjusting sleeves 5 are sleeved on and fixed with the main frame 4 and the movable frame 6 to adjust a height of the movable lifting bracket.

A pressing frame 3 is arranged on the main frame 4. A first handbrake controller 301 and a second handbrake controller 302 are mounted on the pressing frame 3. The pressing frame 3 is connected with the main frame 4 through first fixing pieces 404.

A lower end of each of the bearing frames 1 is connected with a respective end of the pressing frame 3. The bearing frames 1 are connected with the main frame 4 through auxiliary moving rods 2. A limit teeth plate 401 is arranged on an upper portion of the main frame 4 through second fixing pieces 405. The limit teeth plate 401 is arc-shaped. Camping teeth are arranged on an outer side of the limit teeth plate 401. A limit plate 402 matched with the limit teeth plate 401 is arranged on one end of the pressing frame 3. A horizontal plate engaged with the clamping teeth is arranged on an inner side of the limit plate. A tension spring 403 is connected to a lower side of the limit plate 402. Cushions 101 are arranged on an upper portion of each of the bearing frames 1. A first adjusting bolt is connected with a lower end of each of the cushions 101. Each of the cushions 101 are connected with each of the bearing frames 1 through a corresponding first adjusting bolt. A fixed frame 102 is connected with a lower side of each of the bearing frames 1. Auxiliary support rods 8 are connected with one side of the fixed frame 102. A support block 801 is arranged on one end of each of the auxiliary support rods 8. A second adjusting bolt is connected with a lower end of each of the support block 801. Each support block 801 is connected with each of the auxiliary support rods 8 through each second adjusting bolt.

In the embodiment, each of the bearing frames 1 is connected with the pressing frame 3 through a third fixing piece. The bearing frames 1 and the main frame 4 are connected with the auxiliary moving rods 2 through fourth fixing pieces When a vehicle roof needs to be lifted upwards, a user only needs to press down one side of the pressing frame to apply a downward force, then the pressing frame 3 rotates with the first fixing pieces 404 connected to the main frame 4 as a center of the circle, so that another ends connected with the bearing frames 1 moves upward under action of the lever principle. Therefore, the bearings frames 1 drive the vehicle roof to move upward to achieve effect that the vehicle roof is lifted up by manpower without using heavy equipment.

In the embodiment, the horizontal plate of the limit plate 402 is engaged with the clamping teeth of the limit teeth plate 401. The fifth fixing piece 303 is arranged on a middle portion of the limit plate 402. Therefore, when the pressing frame 3 is rotated by applying force, the limit plate 402 intermittently overcome force of the tension spring 403 under action of the clamping teeth to rotate with a center of the fifth fixing piece 303 as a center. When stop applying the force, the limit plate 402 is engaged with the limit teeth plate 401, and a rotation angle of the pressing frame 3 and a move-up height of the bearing frames 1 are fixed, thereby achieving effect of lifting or fixing the vehicle roof at any time, which greatly improves disassembly efficiency of the vehicle roof.

In the embodiment, a control wire of the first handbrake controller 301 is connected with an upper end of the limit plate 402. When the bearing frames 1 need to be reset, the first handbrake controller 301 is pulled to drive the limit plate 402 to rotate to release engagement with the limit teeth plate 401, so that the bearing frames 1 are quickly reset.

In the embodiment, the first pieces, the second fixing pieces, the third fixing pieces, the fourth fixing pieces, and the fifth fixing piece are selected from screws, stop shafts, which is not limited thereto.

Embodiment 2

The movable lifting bracket in the embodiment includes all structures of the movable lifting bracket in the first embodiment. Differences between the movable lifting bracket in the embodiment and the first embodiment are as follows:

Stabilizing support mechanisms 9 are connected with the bearing frames. A lower portion of each of the bearing frame 1 is received in an interior of a respective stabilizing support mechanism 9. An outer sleeve 14 is arranged on one side of each of the stabilizing support mechanisms 9. A connecting rod 13 is arranged on one side of each outer sleeve 14. An abutting block 10 is arranged at one end of each connecting rod 13.

In one embodiment, the upper end of each abutting block 10 is arc-shaped, and the upper end of each abutting block 10 is made of rubber material, which increase a contact area between each abutting block 10 and an edge of the vehicle roof, thereby improving stability of the vehicle roof during transportation.

In one embodiment, a spring 901 is arranged in the interior of each of the stabilizing support mechanisms 9. A pressing plate 12 is arranged on an outer side of the lower portion of each of the bearing frames 1. One end of each pressing plate 12 inserts into an interior of a corresponding outer sleeve 14. A lower end of each pressing plate 12 is inclined, and one end of the outer sleeve 14 inserted into the stabilizing support mechanism 9 is inclined.

When the bearing frames 1 support the vehicle roof, each spring 901 in the corresponding stabilizing support mechanism 9 is compressed, so each pressing plate 12 enters the corresponding stabilizing support mechanism 9 and contacts with one side of the corresponding outer sleeve 14. Thus, each outer sleeve 14 drives the corresponding connecting rod 13 and the corresponding abutting block 10 to move outward to contact the edge of the vehicle roof to support the edge of the vehicle roof, so that when the vehicle roof is transported on a road that is inclined or uneven, they also prevent the vehicle roof from sliding over on the upper portions of the bearing frames 1, thereby improving the stability of the vehicle roof during transportation.

In one embodiment, each outer sleeve 14 is sleeved on an outer side of each connecting rod 13. Fourth through holes 141 are on each outer sleeve 14 and each connecting rod 13. A stop pin 142 is arranged on each outer sleeve. Each outer sleeve 14 is connected with a corresponding connecting rod 13 though cooperation of the fourth through holes 141 and a corresponding stop pin 142, so a length of each connecting rod 13 into the corresponding outer sleeve 14 is adjusted and the movable lifting bracket adapts to different types of vehicle roofs.

In one embodiment, a clamping mechanism 15 is arranged on an outer side of an upper end of each of the stabilizing support mechanisms 9. A clamping block 11 is arranged on an outer side of the lower portion of each of the bearing frames 1. The second handbrake controller 302 is connected with one end of a corresponding clamping mechanism 15. When each of the bearing frames 1 compresses the corresponding spring 901 in the corresponding stabilizing support mechanism 9, each clamping block 11 is engaged with the corresponding clamping mechanism 15, thereby further improving the stability of the vehicle roof during subsequent transportation. The second handbrake controller 302 is pulled to quickly released engagement of each clamping block 11 with the corresponding clamping mechanism 15.

A working principle of the movable lifting bracket is as follow:

With the universal wheels 601 and the directional wheels 602 arranged on the lower portion of the movable frame 6, the movable frame 6 is manually pushed to move by manpower, so the movable frame 6 is quickly moves under a vehicle roof that needs to be removed.

The pressing frame 3 is arranged on the main frame 4. The pressing frame 3 is connected with the main frame 4 through fixing pieces 404. The lower end of each of the bearing frames 1 is connected with the respective end of the pressing frame 3. When the vehicle roof needs to be lifted upwards, the user only needs to press down one side of the pressing frame 3 to apply the downward force, then the pressing frame 3 rotates with the fixing pieces 404 connected to the main frame 4 as a center of the circle, so that another ends connected with the bearing frames 1 moves upward under action of the lever principle. Therefore, the bearings frames 1 drive the vehicle roof to move upward to achieve effect that the vehicle roof is lifted up by manpower without using heavy equipment. The bearing frames 1 are connected with the main frame through the auxiliary moving rods 2, which improves stability of the bearing frames 1 when moving up. The limit teeth plate 401 is arranged on the upper end of the main frame. The limit teeth plate 401 is arc-shaped. The clamping teeth are arranged on the outer side of the limit teeth plate 401. The limit plate matched with the limit teeth plate 401 is arranged on one end of the pressing frame 3. The tension spring 403 is connected to the lower side of the limit plate.

Therefore, when the pressing frame 3 is rotated by applying force, the limit plate intermittently overcome force of the tension spring 403 under action of the clamping teeth to rotate with a center of the fifth fixing piece as a center. When stop applying the force, the limit plate is engaged with the limit teeth plate 401, and a rotation angle of the pressing frame 3 and a move-up height of the bearing frames 1 are fixed, thereby achieving effect of lifting or fixing the vehicle roof at any time, which greatly improves disassembly efficiency of the vehicle roof.

The cushions 101 are arranged on the upper portion of each of the bearing frames 1. The first adjusting bolt is connected with the lower end of each of the cushions 101. Each of the cushions 101 are connected with each of the bearing frames 1 through the corresponding first adjusting bolt. By controlling an upward extension length of each first adjusting bolt, each of the cushions 101 contacts with an uneven inner surface of the vehicle roof to avoid deformation of the vehicle roof caused by uneven force.

The fixed frame 102 is connected with the lower side of each of the bearing frames 1. The auxiliary support rods 8 are connected with one side of the fixed frame 102. The support block 801 is arranged on the one end of each of the auxiliary support rods 8. The second adjusting bolt is connected with the lower end of each of the support block 801. Each support block 801 is connected with each of the auxiliary support rods 8 through each second adjusting bolt. Therefore, a contact area between the bearing frames 1 and an inner side of the vehicle roof is increased, which improves stability of subsequent transportation. Moreover, each support block 801 contacts with the uneven inner surface of the vehicle roof to ensure that the force on the inner side of the vehicle roof is even.

The adjusting sleeves are sleeved on the upper ends of the movable frame and lower ends of the main frame. The first through holes are on the outer side of each of the adjusting sleeves. The second through holes are on the outer sides of the main frame. The third through holes are on the outer sides of the movable frame. The first limits pins insert into the first through holes and the second through holes to fix the adjusting sleeves with the main frame. The second limit pins insert into the first through holes and the third through holes to fix the adjusting sleeves with the movable frame. The adjusting sleeves are sleeved on and fixed with the main frame and the movable frame to adjust a height of the movable lifting bracket. Therefore, the movable lifting bracket adapts to disassembly of the vehicle roof of different models of vehicles.

By providing the non-slip sleeve mounted on the outer side of the pressing frame 3, use of the movable lifting bracket is further facilitated.

The stabilizing support mechanisms 9 are connected with the bearing frame 1. The lower portion of each of the bearing frame 1 is received in the interior of the respective stabilizing support mechanism 9. The outer sleeve is arranged on one side of each of the stabilizing support mechanisms. The connecting rod 13 is arranged on one side of each outer sleeve 14. The abutting block 10 is arranged at one end of each connecting rod 13. When the bearing frames 1 support the vehicle roof, each spring 901 in the corresponding stabilizing support mechanism 9 is compressed, so each pressing plate 12 enters the corresponding stabilizing support mechanism 9 and contacts with one side of the corresponding outer sleeve 14. Thus, each outer sleeve 14 drives the corresponding connecting rod 13 and the corresponding abutting block 10 to move outward to contact an edge of the vehicle roof to support the edge of the vehicle roof, so that when the vehicle roof is transported on a road that is inclined or uneven, they also prevent the vehicle roof from sliding over on the upper portions of the bearing frames 1, thereby improving the stability of the vehicle roof during transportation.

The upper end of each abutting block 10 is arc-shaped, and the upper end of each abutting block 10 is made of rubber material, which increase a contact area between each abutting block 10 and the edge of the vehicle roof, thereby improving the stability of the vehicle roof during transportation. Each outer sleeve 14 is sleeved on the outer side of each connecting rod 13. The fourth through holes 141 are on each outer sleeve 14 and each connecting rod 13. A stop pin 142 is arranged on each outer sleeve 14. Each outer sleeve 14 is connected with the corresponding connecting rod 13 though cooperation of the fourth through holes 141 and the corresponding stop pin 142, so a length of each connecting rod 13 into the corresponding outer sleeve 14 is adjusted and the movable lifting bracket adapts to different types of vehicle roofs.

The first handbrake controller 301 and the second handbrake controller 302 are mounted on the pressing frame 3. The control wire of the first handbrake controller 301 is connected with the upper end of the limit plate. When the bearing frames 1 need to be reset, the first handbrake controller 301 is pulled to drive the limit plate to rotate to release engagement with the limit teeth plate 401, so that the bearing frames 1 are quickly reset.

The clamping mechanism 15 is arranged on the outer side of the upper end of each of the stabilizing support mechanisms 9. The clamping block 11 is arranged on the outer side of the lower portion of each of the bearing frames 1. The second handbrake controller is connected with one end of the corresponding clamping mechanism 15.

When each of the bearing frames 1 compresses the corresponding spring 901 in the corresponding stabilizing support mechanism 9, each clamping block is engaged with the corresponding clamping mechanism 15, thereby further improving the stability of the vehicle roof during subsequent transportation. The second handbrake controller is pulled to quickly released engagement of each clamping block with the corresponding clamping mechanism 15.

What is claimed is:

1. A movable lifting bracket, comprising:

bearing frames;

a main frame; and a mobile frame arranged on a lower portion of the main frame;

wherein a pressing frame is arranged on the main frame; the pressing frame is connected with the main frame through first fixing pieces; the bearing frames are arranged above the main frame; a lower end of each of the bearing frames is connected with the pressing frame; a limit teeth plate is arranged on the main frame and a limit plate matched with the limit teeth plate is arranged on the pressing frame; a fixed frame is connected with a lower side of each of the bearing frames; auxiliary support rods are connected with one side of the fixed frame; universal wheels and directional wheels are arranged on a lower portion of the movable frame;

wherein adjusting sleeves are sleeved on upper ends of the movable frame; the adjusting sleeves are sleeved on lower ends of the main frame; first through holes are on an outer side of each of the adjusting sleeves; second through holes are on outer sides of the main frame; third through holes are on outer sides of the movable frame; the movable limiting frame further comprises first limit pins and second limit pins: the first limits pins insert into the first through holes and the second through holes to fix the adjusting sleeves with the main frame; the second limit pins insert into the first through holes and the third through holes to fix the adjusting sleeves with the movable frame; the adjusting sleeves are sleeved on and fixed with the main frame and the movable frame to adjust a height of the movable lifting bracket.

2. The movable lifting bracket according to claim 1, wherein the bearing frames are connected with the main frame through auxiliary moving rods.

3. The movable lifting bracket according to claim 1, wherein cushions are arranged on an upper portion of each of the bearing frames; the cushions are connected with each of the bearing frames through first adjusting bolts.

4. The movable lifting bracket according to claim 1, wherein a support block is arranged on one end of each of the auxiliary support rods; each support block is connected with each of the auxiliary support rods through a second adjusting bolt.

5. The movable lifting bracket according to claim 1, wherein the movable lifting bracket further comprises stabilizing support mechanisms; a connecting rod is arranged on one side of each of the stabilizing support mechanisms; each connecting rod is connected with a respective abutting block; each connecting rod is movable outward; the lower end of each of the bearing frames inserts into a corresponding stabilizing support mechanism.

6. The movable lifting bracket according to claim 5, wherein an upper end of each abutting block is made of soft material; the upper end of each abutting block is arc-shaped; an outer sleeve is arranged on one side of each connecting rod; a pressing plate is arranged on a lower portion of each of the bearing frames.

7. The movable lifting bracket according to claim 5, wherein a clamping mechanism is arranged on an outer side of an upper end of each of the stabilizing support mechanisms, a clamping block snapped on each clamping mechanism is arranged on a lower end of each of the bearing frames.

8. A movable lifting bracket, comprising:

bearing frames;

a main frame; and a mobile frame arranged on a lower portion of the main frame;

wherein a pressing frame is arranged on the main frame; the pressing frame is connected with the main frame through first fixing pieces; the bearing frames are arranged above the main frame; a lower end of each of the bearing frames is connected with the pressing frame; a limit teeth plate is arranged on the main frame and a limit plate matched with the limit teeth plate is arranged on the pressing frame; a fixed frame is connected with a lower side of each of the bearing frames; auxiliary support rods are connected with one side of the fixed frame; universal wheels and directional wheels are arranged on a lower portion of the movable frame;

wherein the limit teeth plate is connected with the pressing frame through second fixing pieces, one end of the limit teeth plate is connected with a tension spring; the limit teeth plate is arc-shaped; clamping teeth are arranged on an outer side of the limit teeth plate; the clamping teeth are continuously and equidistantly arranged; a horizontal plate engaged with the clamping teeth is arranged on an inner side of the limit plate.

9. A movable lifting bracket, comprising:

bearing frames;

a main frame; and a mobile frame arranged on a lower portion of the main frame;

wherein a pressing frame is arranged on the main frame; the pressing frame is connected with the main frame through first fixing pieces; the bearing frames are arranged above the main frame; a lower end of each of the bearing frames is connected with the pressing frame; a limit teeth plate is arranged on the main frame and a limit plate matched with the limit teeth plate is arranged on the pressing frame; a fixed frame is connected with a lower side of each of the bearing frames; auxiliary support rods are connected with one side of the fixed frame; universal wheels and directional wheels are arranged on a lower portion of the movable frame;

wherein a first handbrake controller is arranged on a first side of the pressing frame; a control wire of the first handbrake controller is connected with the limit plate, and a second handbrake controller is arranged on a second side of the pressing frame.

* * * * *